United States Patent [19]

Bosserman

[11] 4,184,069

[45] Jan. 15, 1980

[54] ORTHOGONAL ARRAY FACEPLATE WAFER TUBE DISPLAY

[75] Inventor: David A. Bosserman, Alexandria, Va.

[73] Assignee: The United States of America as represented by the Secretary of the Army, Washington, D.C.

[21] Appl. No.: 891,107

[22] Filed: Mar. 28, 1978

[51] Int. Cl.[2] ..... H01J 43/04; H01J 31/26

[52] U.S. Cl. ..... 250/213 VT; 250/207; 313/105 CM; 315/12 R

[58] Field of Search ..... 250/213 R, 213 VT, 207; 358/211, 241; 313/103 R, 103 CM, 105 R, 105 CM, 373, 375, 377, 379, 387, 399, 400; 315/12 R, 12 ND

[56] References Cited

U.S. PATENT DOCUMENTS

| | | | |
|---|---|---|---|
| 3,646,382 | 2/1972 | Goede et al. | 313/103 CM X |
| 3,885,180 | 5/1975 | Carts, Jr. | 250/213 R X |
| 4,020,376 | 4/1977 | Bosserman et al. | 250/213 R X |
| 4,024,390 | 5/1977 | Bosserman et al. | 250/213 VT |
| 4,024,391 | 5/1977 | Bosserman et al. | 250/213 VT |
| 4,031,552 | 6/1977 | Bosserman et al. | 313/105 CM X |
| 4,110,014 | 8/1978 | Yevick | 250/213 R X |

*Primary Examiner*—David C. Nelms
*Assistant Examiner*—Edward P. Westin
*Attorney, Agent, or Firm*—Nathan Edelberg; Milton W. Lee; Max L. Harwell

[57] ABSTRACT

Minature video-type display comprised of an otherwise normal microchannel plate (MCP) image intensifier wafer tube which uses, instead of the normal input faceplate having a uniform photocathode, a video-driven one-dimensional electroluminescent array on the output surface thereof and an orthogonal one-dimensional photocathode array mounted on the inner surface thereof. The fiber optic faceplate contains vacuum feedthroughs for the cathode array elements.

4 Claims, 4 Drawing Figures

ORTHOGONAL ARRAY FACEPLATE WAFER TUBE DISPLAY

The invention described herein may be manufactured, used, and licensed by the U.S. Government for governmental purposes without the payment of any royalties thereon.

BACKGROUND OF THE INVENTION

This invention is a result of continuing display development for applictions in the U.S. Army night viewing devices. Previous patent applications for displays which utilize MCP image intensifier tubes were filed Apr. 9, 1976 with the application Ser. No. 675,366 and 675,367, now U.S. Pat. Nos. 4,024,390 and 4,024,319 issued to co-inventors Charles F. Freeman and the present inventor. The present faceplate may be used in these displays with the arrays being removed from the photocathode and MCP proximity focus areas and the present orthogonal array faceplate having electroluminescent and photocathode arrays thereon being used.

SUMMARY OF THE INVENTION

The critical assembly of this invention is built upon a fiber optic faceplate which has a video-modulated, one-dimensional, M-element electroluminescent (EL) array on its outer surface and an orthogonal, one-dimensional, N-element photocathode array on its inner surface with one lead to the outer surface from each of the N photocathode array elements. This unique faceplate assembly forms an orthogonal array on MXN Pixels, and together with an otherwise normal MCP image intensifier tube which has a photocathode-MCP proximity spacing, constitutes a visual display of digital or analog data with various possible scan schemes. Standard tube configurations and components have been retained, except for the present input faceplate and photocathode surface and specialized control electrons.

DETAILED DESCRIPTION OF THE PREFERRED EMBODIMENT

Figure 1:
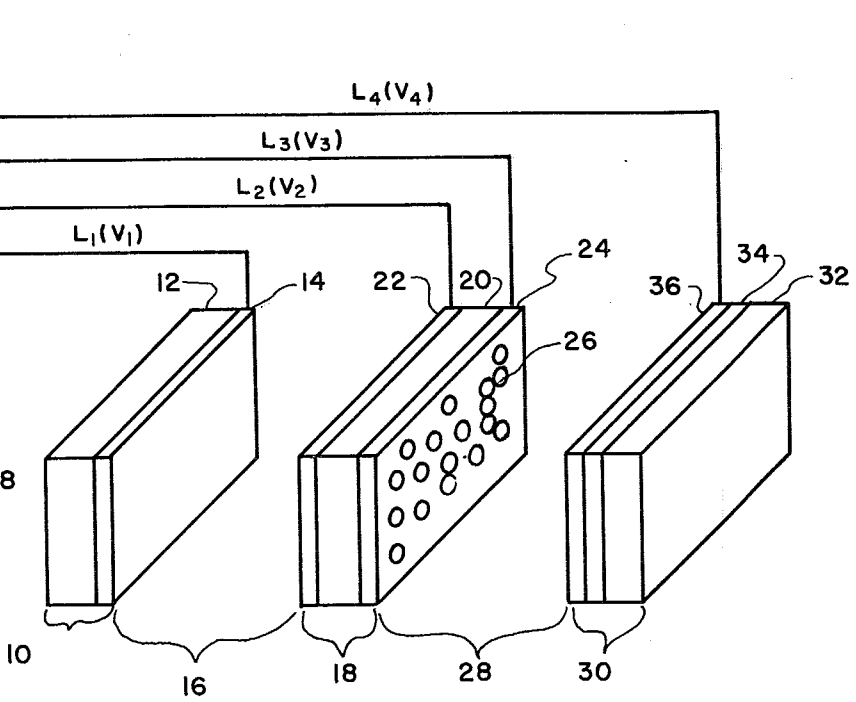
FIG. 1 PRIOR ART
FIG. 1 shows a schematic of the working elements of a standard MCP image intensifier wafer tube.

The preferred embodiment of this invention utilizes standard components of standard MCP image intensifier wafer tubes, except for the present input faceplate assembly. Look now at FIG. 1 for a summary of the basic working components and operation of a wafer tube. There are three major components, (1) the input faceplate or orthogonal array assembly 10 with input faceplate 12 and photocathode 14, (2) the MCP assembly 18 with the MCP 20 having input electrode 22 and output electrode 24, and (3) the output assembly 30 composed of outer faceplate 32, phosphor screen 34 and phosphor electrode 36. A vacuum envelope (not shown) is sealed to the input and output faceplates 12 and 32 respectively. There are four leads L1, L2, L3 and L4 that are respectively connected to the cathode 14 and to the three electrodes 22, 24, and 36 via vacuum feed-throughs (not shown) to the electronics and power supplies package 8, and which supply the operational voltages V1, V2, V3 and V4 respectively. The voltages are arranged in step up amounts (V1, V2, V3, V4) such that photoelectrons from the cathode 14 are accelerated across the cathode-MCP proximity space 16 impacting the microchannels 26 in the MCP 20 with sufficient energy to create secondary electrons and that these secondary electrons cascade down and out of the electron multiplication channels 26. There are many electrons exiting channels 26 for every one entering. The exiting secondary electrons are accelerated across the MCP-phosphor proximity space 28 with sufficient energy to penetrate phosphor electrode 36 and excite the phosphor 34 sufficiently to cause emission of light that can be observed through the output faceplate 32 by an observer.

Typical MCP wafer tube operating voltages would be V1=ground, V2=200 volts, V3=800 volts, V4=5800 volts.

Figure 3:
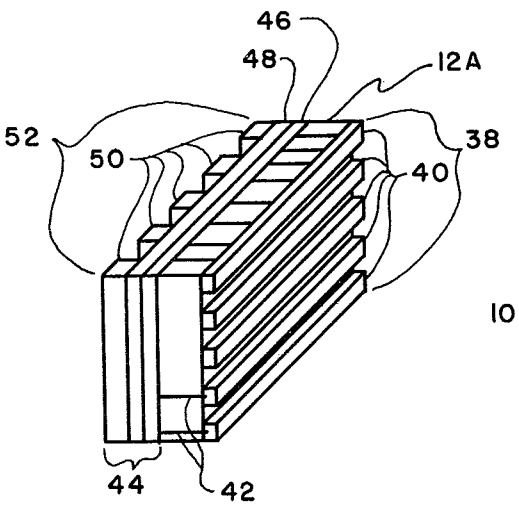
FIG. 3 illustrates the orthogonal array assembly of the present assembly.
Figure 2:
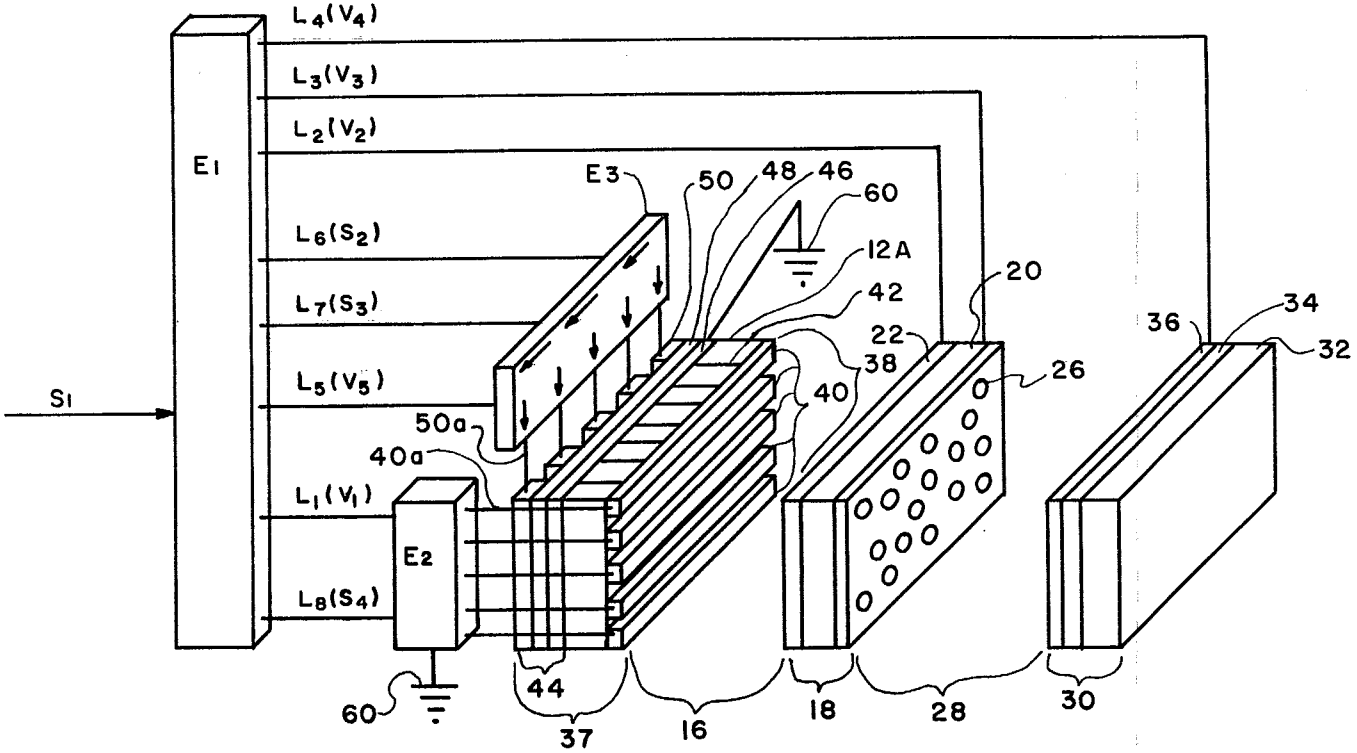
FIG. 2 is a schematic of the video display utilizing the MCP wafer tube with orthogonal electroluminescent and cathode one-dimensional arrays on the input faceplate and the accompanying control electronics.

The present invention retains all of the MCP wafer tube features but replaces the simple faceplate photocathode input assembly 10 with an improved crossed array input faceplate assembly 37 as shown in FIG. 2. The orthogonal array faceplate is shown isolated in FIG. 3. FIG. 2 retains the symbology of FIG. 1 for the unchanged components. The crossed array input assembly 37, as shown in FIG. 3, is made up of a fiber optic faceplate 12A with a cathode array 38 of parallel cathode stripes 40 on the inner surface and an electroluminescent array 44 on the outer surface. Each of the plurality of N cathode stripes 40 is connected to a faceplate vacuum feedthrough 42 which, in turn, is connected to the cathode array electronics E2. The electroluminescent array 44 is composed of a transparent electrode 46 contiguous with the outer surface of faceplate 12A and electroluminescent layer 48 contiguous with this transparent electrode 46 and an electrode array 52 made of a plurality of M parallel electrode stripes 50 laid upon layer 48. The M parallel electrode stripes 50 are orthogonal to the N parallel cathode stripes 40. The common areas formed by the geometric projection of one array upon the other form the MXN Pixels of the display.

The control electronic means E1 receive a video-type serial input S1 and converts this to a modified video line signal S2 as required by the electroluminescent array electronics means E3 and delivered over lead L6. A timing signal S3 and an AC power signal of peak-to-peak volts, and designated as V5, are also delivered over leads L7 and L5 respectively to the electroluminescent array electronic means E3. The electroluminescent array electronic means E3 divides the incoming video-type signal S3 line-at-a-time into a plurality of M components, such as M-line accumulators, which then dumps these M signals onto electroluminescent gates of an M-element transistor array which proportionally gates AC power to the M electroluminescent electrode stripes 50 by way of leads **50*a*. In this parallel dumped line-at-a time mode, each successive video line is represented by proportional radiation from the M electroluminescent stripes. The control electronic means E1 also supplies the usual tube operating voltages as discussed before, but the cathode voltage V1 on lead L1 is now delivered to the cathode array electronic means E2 together with a timing signal S4 delivered over the lead L8. The cathode array electronic means E2 gates on the plurality of N cathode stripes 40 by way of leads 40A** one-at-a time leaving all others off. In this fashion, and by employing line rate electronics and electroluminescent material, a video type scan may be obtained.

Typical operating voltages would be V1=20 volts, V2=ground, V3=700 volts, V4=5700 volts, V5=100 volts AC peak-to-peak.

Figure 4:
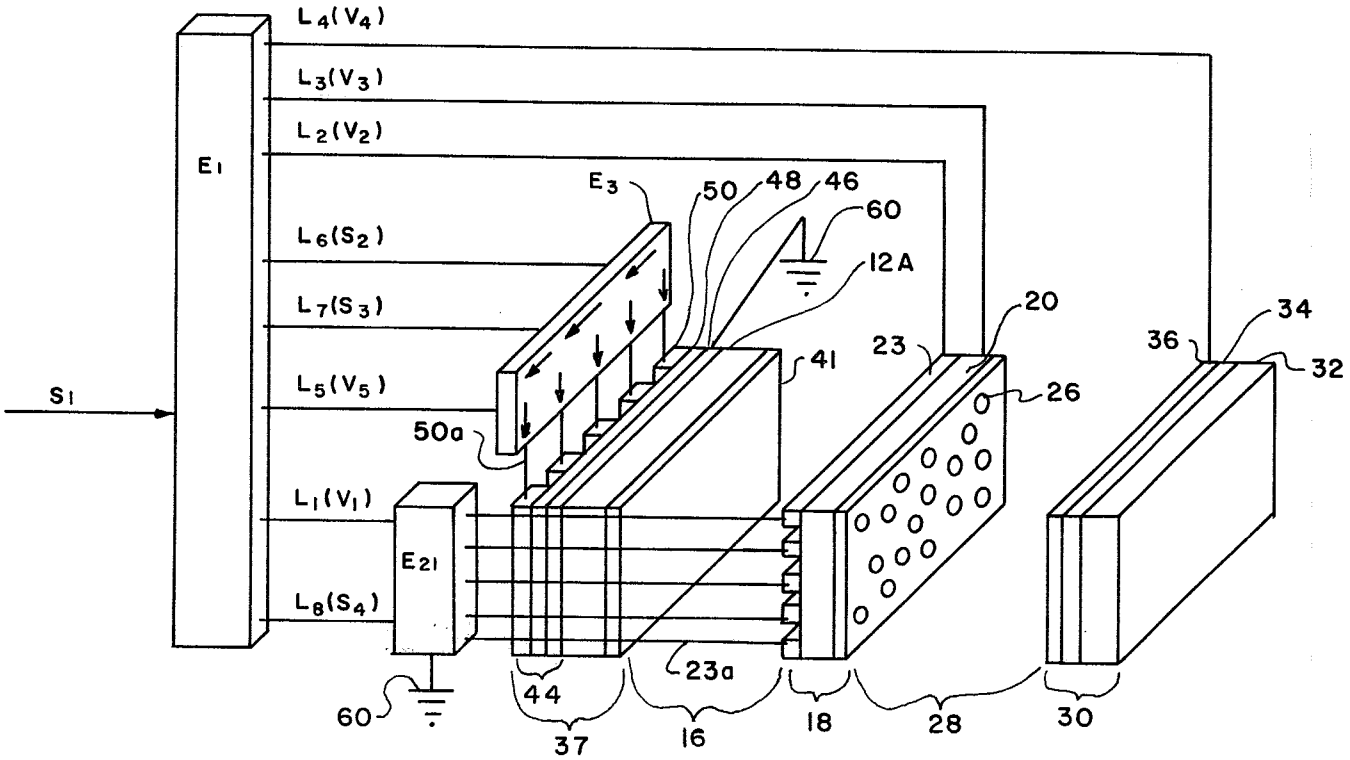
FIG. 4 is a schematic of the video display using a MCP with input electrodes orthogonal to an electroluminescent array on the faceplate.

FIG. 4 illustrates a second embodiment of the present invention utilizing the video-driven one-dimensional electroluminescent array 44 the same as explained with reference to FIG. 2 but with a solid photocathode layer 41 on the opposite side of the fiber optic faceplate 12A. The orthogonal array in this embodiment is that a plurality of input electrodes 23, or MCP input electrode array of N parallel stripes. Voltages to electrodes 23 are switched by a MCP input electrode array electronic means E21 sending signals to 23 over leads **23*a*.Leads 23*a*** are connected to the MCP input electrode array electronic means by M vacuum feedthroughs.

It should be understood that the foregoing disclosure relates to only a preferred embodiment of the invention and that numerous modifications or alterations may be made therein without department from the spirit and scope of the invention as set forth in the appended claims.

I claim:

1. A picture element array image intensifier tube comprising:

an output assembly in proximity focused position to a microchannel plate electron multiplier, an orthogonal array faceplate in proximity focus with said microchannel plate electron multiplier, said faceplate having an N-element one-dimensional photocathode array on the inner surface thereof and having an M-element videodriven one-dimensional electroluminescent array on the outer surface thereof which is orthogonal to said one-dimensional photocathode array; and control electronic means biasing said M-element video-driven one-dimension electroluminescent array and said N-element one-dimensional photocathode array for providing MXN Pixels at the output thereof.

2. The image intensifier tube as set forth in claim 1 wherein said orthogonal array faceplate is comprised of a fiber optic faceplate having on its outer-surface an M-element one-dimensional electroluminescent array that is comprised of a transparent electrode contiguous with said fiber optic faceplate and an electroluminescent layer contiguous with said transparent electrode with an array of M parallel electrode stripes laid upon said electroluminescent layer wherein each of said M parallel electrode stripes is connected to the electroluminescent array electronics means of said control electronics means and wherein said fiber optic faceplate further has on its inner surface an N-element one-dimensional cathode array comprised of an array of N parallel cathode stripes contiguous with the inner surface of said fiber optic faceplate in which each of said N parallel cathode stripes is connected to a faceplate vacuum feedthrough to the cathode array electronic means of said control electronic means wherein said control electronic means controls an incoming video-type signal by geometric projection of said electroluminescent array upon said cathode array to form said MXN Pixels of the display.

3. The image intensifier tube as set forth in claim 2 wherein said cathode array electronic means switches voltages onto each of said N parallel cathode stripes and said electroluminescent array electronic means accepts serial video-type signals on a one-line-at-a-time basis then dumps the M line-signals onto M gates of an M-element transistor array wherein said M-element transistor array proportionally gates an AC signal onto said M parallel electrode stripes forming said M-element one-dimensional electroluminescent array.

4. A picture element array image intensifier tube comprising:

a microchannel plate electron multiplier having an input electrode comprised of an array of N-parallel input electrode stripes and a solid output electrode;

an output assembly in proximity focused position to the output electrode of said microchannel plate electron multiplier;

an array faceplate in proximity focus with said microchannel plate electron multiplier, said faceplate having a solid photocathode layer on the inner surface thereof and having an M-element video-driven one-dimensional electroluminescent array on an outer surface thereof wherein said M-element video-driven one-dimensional electroluminescent array is orthogonal to said array of N-parallel input electrode stripes and said photocathode layer is in proximity focus with said N-parallel input electrode stripes; and control electronic means associated with M-element video-driven one-dimensional electroluminescent array and said N-parallel input electrode stripes for providing MXN Pixels at the output thereof.

* * * * *